US010794092B2

(12) United States Patent
Yu et al.

(10) Patent No.: US 10,794,092 B2
(45) Date of Patent: Oct. 6, 2020

(54) LOCK BOX

(71) Applicant: SINOX CO., LTD, New Taipei (TW)

(72) Inventors: Chang-Chiang Yu, New Taipei (TW); Chia-Hung Wang, New Taipei (TW); Chien-Hung Wu, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 197 days.

(21) Appl. No.: 16/119,185

(22) Filed: Aug. 31, 2018

(65) Prior Publication Data

US 2019/0071897 A1 Mar. 7, 2019

(30) Foreign Application Priority Data

Sep. 1, 2017 (TW) ..... 106213047 U

(51) Int. Cl.

| | |
|---|---|
| ***E05B 65/52*** | (2006.01) |
| ***A45C 13/20*** | (2006.01) |
| ***E05G 1/00*** | (2006.01) |
| ***E05B 73/00*** | (2006.01) |
| ***E05G 1/026*** | (2006.01) |
| ***E05G 1/04*** | (2006.01) |
| *E05B 37/02* | (2006.01) |
| *A45C 11/32* | (2006.01) |
| *E05B 19/00* | (2006.01) |

(52) U.S. Cl.

CPC ..... *E05B 65/52* (2013.01); *A45C 13/20* (2013.01); *E05B 65/5284* (2013.01); *E05B 73/0005* (2013.01); *E05G 1/00* (2013.01); *E05G 1/005* (2013.01); *E05G 1/026* (2013.01); *E05G 1/04* (2013.01); *A45C 11/32* (2013.01); *E05B 19/0005* (2013.01); *E05B 37/02* (2013.01)

(58) Field of Classification Search

CPC ..... E05B 65/52; E05B 37/02; E05B 73/0005; E05B 19/0005; E05B 65/5284; E05G 1/00; E05G 1/005; E05G 1/026; E05G 1/04; A45C 13/20; A45C 11/32

USPC ..... 70/63; 109/52

See application file for complete search history.

(56) References Cited

U.S. PATENT DOCUMENTS 4,838,052 A * 6/1989 Williams ..... E05B 19/0005 109/52
5,531,082 A * 7/1996 Wolk ..... A45C 13/20 70/18
7,866,505 B2 * 1/2011 Perlman ..... A45C 13/20 220/835

* cited by examiner

*Primary Examiner* — Suzanne L Barrett
(74) *Attorney, Agent, or Firm* — Birch, Stewart, Kolasch & Birch, LLP

(57) ABSTRACT

The lock box includes a box, a cap, and a cable. The box includes a box opening, a lock hole, and a lock body. The cap includes a cap fixing part, a cap socket, and a restricting device. The cap fixing part is able to extend into the lock hole and be locked by the lock body when the cap covers the box opening. The restricting device has a lifting lever. One end of the cable has a cable fixing part. The cable fixing part can be inserted into the cap socket with its movement being restricted by the restricting device. A user can apply a force on the lifting lever to release the restriction on the movement of the cable fixing part by the restricting device when the cap doesn't cover the box opening.

10 Claims, 9 Drawing Sheets

LOCK BOX

BACKGROUND OF THE INVENTION

1. Field of the Invention

The present invention generally relates to a lock box.

2. Description of the Prior Art

Locks are commonly used to secure the safety of living or space in use, or to prevent stealing or taking objects by mistake. However, it is common that a user cannot open a lock due to the loss of the key. Therefore, lock boxes are provided to keep keys to prevent the aforementioned circumstances.

On the other hand, when people go out, they still need to prevent the theft of the objects they carry, such as hotel room keys or cards. Lock boxes might come in handy.

However, it is less convenient to use conventional lock boxes since the cap and the cable must be locked or unlocked at the same time.

Hence, the conventional lock boxes are still improvable.

SUMMARY OF THE INVENTION

An object of the present invention is to provide a lock box which is more convenient to use.

In one embodiment, the lock box of the present invention includes a box, a cap, and a cable. The box has an accommodating space inside. The box includes a box opening, a lock hole, and a lock body. The lock hole is disposed at a location on the box other than the box opening. The lock body is disposed at a location on the box other than the box opening and the lock hole. The cap is capable of covering the box opening to seal the accommodating space. The cap includes a cap fixing part, a cap socket, and a restricting device. The cap fixing part protrudes from one side of the cap facing the box opening. The cap fixing part is able to extend into the lock hole and be locked by the lock body when the cap covers the box opening. The cap socket is disposed on the other side of the cap with respect to the cap fixing part. The restricting device is disposed in the cap. The restricting device has a lifting lever protruding from one side of the cap facing the box opening. One end of the cable is fixed on either the box or the cap and the other end of the cable has a cable fixing part. The cable fixing part can be inserted into the cap socket with its movement being restricted by the restricting device. The lifting lever is located outside the accommodating space when the cap doesn't cover the box opening. A user can apply a force on the lifting level to release the restriction on the movement of the cable fixing part by the restricting device.

In one embodiment, the restricting device includes the lifting level, a block, and an elastic member. The block connects with the lifting level. The cable fixing part can be inserted into the cap socket and engages with the block. The elastic member is disposed between the block and the inner wall of the cap.

In one embodiment, the cable fixing part is a hook-shaped unit.

In one embodiment, the block includes a block hole, wherein the cable fixing part can be inserted into the cap socket and engages with the edge of the block hole.

In one embodiment, the block includes an engaging portion, wherein the cable fixing part can be inserted into the cap socket and engages with the engaging portion.

In one embodiment, the cable fixing part includes a fixing hole.

In one embodiment, the block includes an engaging part. The cable fixing part can be inserted into the cap socket and makes the engaging part engage with the edge of the fixing hole.

In one embodiment, the cap is pivotally connected with one side of the box.

In one embodiment, the cap is removable form the box.

In one embodiment, the cap fixing part is a hook-shaped unit.

Accordingly, in the lock box of the present invention, one can choose to lock or unlock the cap and the cable respectively.

It is to be understood that the above description and the embodiments below are merely illustrative and are not to be considered limitations to the scope of the invention.

BRIEF DESCRIPTION OF THE DRAWINGS

FIGS. 2-3B are schematic views of the lock box of the present invention show that the cap is open on the box and the cable is locked.

DETAILED DESCRIPTION OF THE PREFERRED EMBODIMENT

Figure 1:
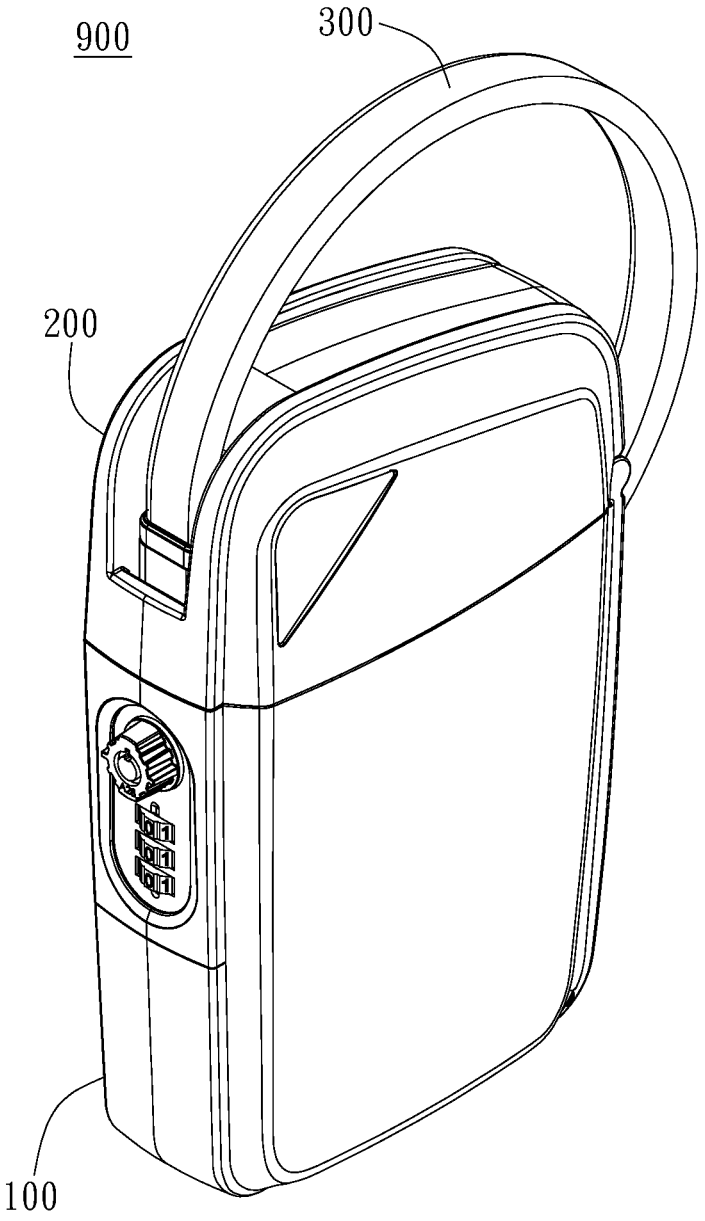
FIG. 1 is schematic view of the lock box of the present invention shows that the cap covers the box and the cable is locked.
Figure 2:
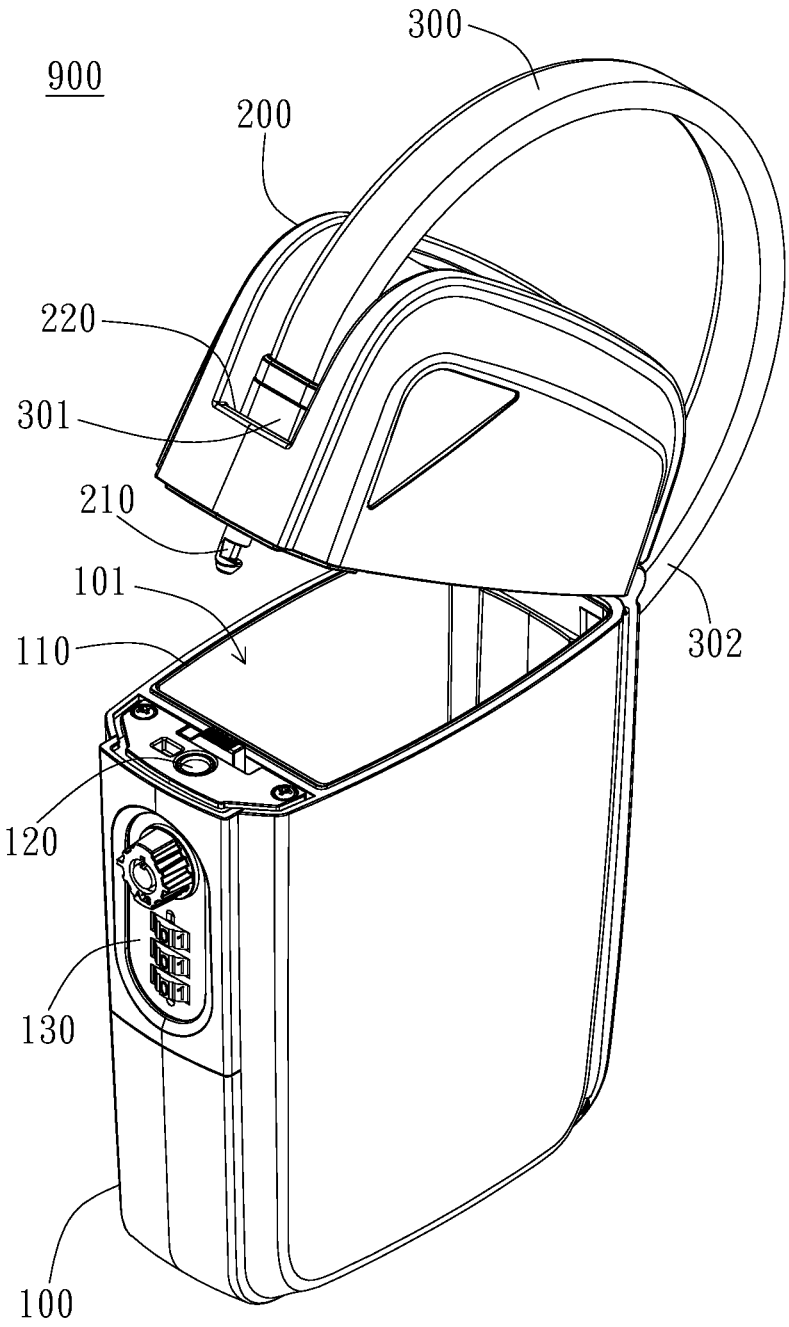

As shown in FIG. 1 and FIG. 2, the lock box 900 of the present invention includes a box 100, a cap 200, and a cable 300. As shown in FIG. 2, the box 100 has an accommodating space 101 inside. The box 100 includes a box opening 110, a lock hole 120, and a lock body 130. The lock hole 120 is disposed at a location on the box 100 other than the box opening 110. The lock body 130 is disposed at a location on the box 100 other than the box opening 110 and the lock hole 120. The cap 200 is capable of covering the box opening 110 to seal the accommodating space 101. As shown in the embodiment in FIGS. 1 and 2, the cap 200 is pivotally connected with one side of the box 100, wherein the cap 200 can rotate and be lift up with respect to the box 100. In different embodiments, however, the cap 200 could be completely removable from the box 100.

Figures 3A, 3B:
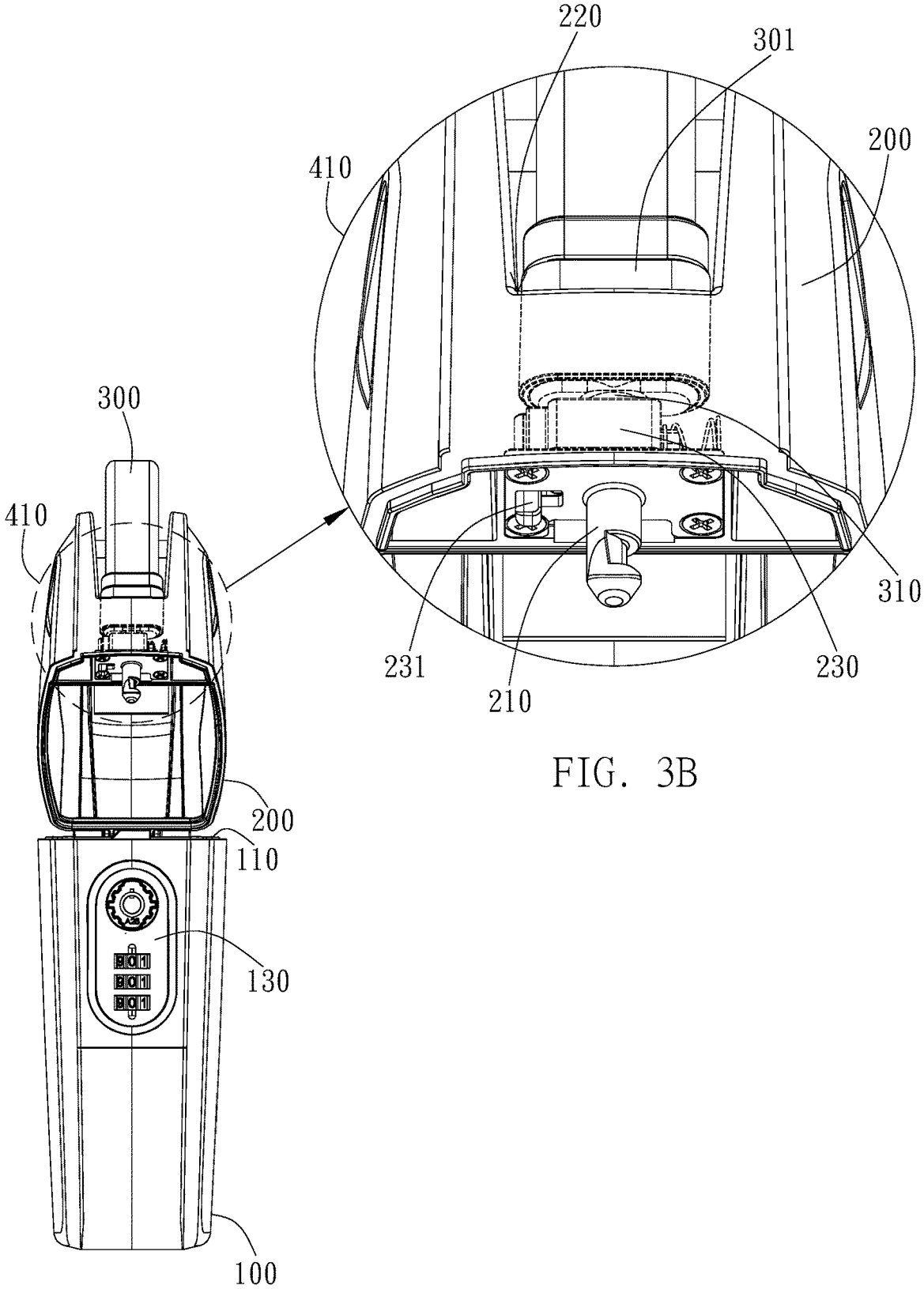

As shown in the embodiment in FIGS. 3A and 3B, the cap 200 includes a cap fixing part 210, a cap socket 220, and a restricting device 230. The cap fixing part 210 protrudes from one side of the cap 200 facing the box opening 110. The cap fixing part 210 is able to extend into the lock hole 120 (see FIG. 2) and be locked by the lock body 130 when the cap 200 covers the box opening 110. In this embodiment, the cap fixing part 210 is a hook-shaped unit. In different embodiments, however, the structure of the cap fixing part 210 can be modified according to the manufacturing, design, and usage requirements. The cap socket 220 is disposed on the other side of the cap 200 with respect to the cap fixing part 210. The restricting device 230 is disposed in the cap 200. The restricting device 230 has a lifting lever 231 protruding from one side of the cap 200 facing the box opening 110.

Figure 4:
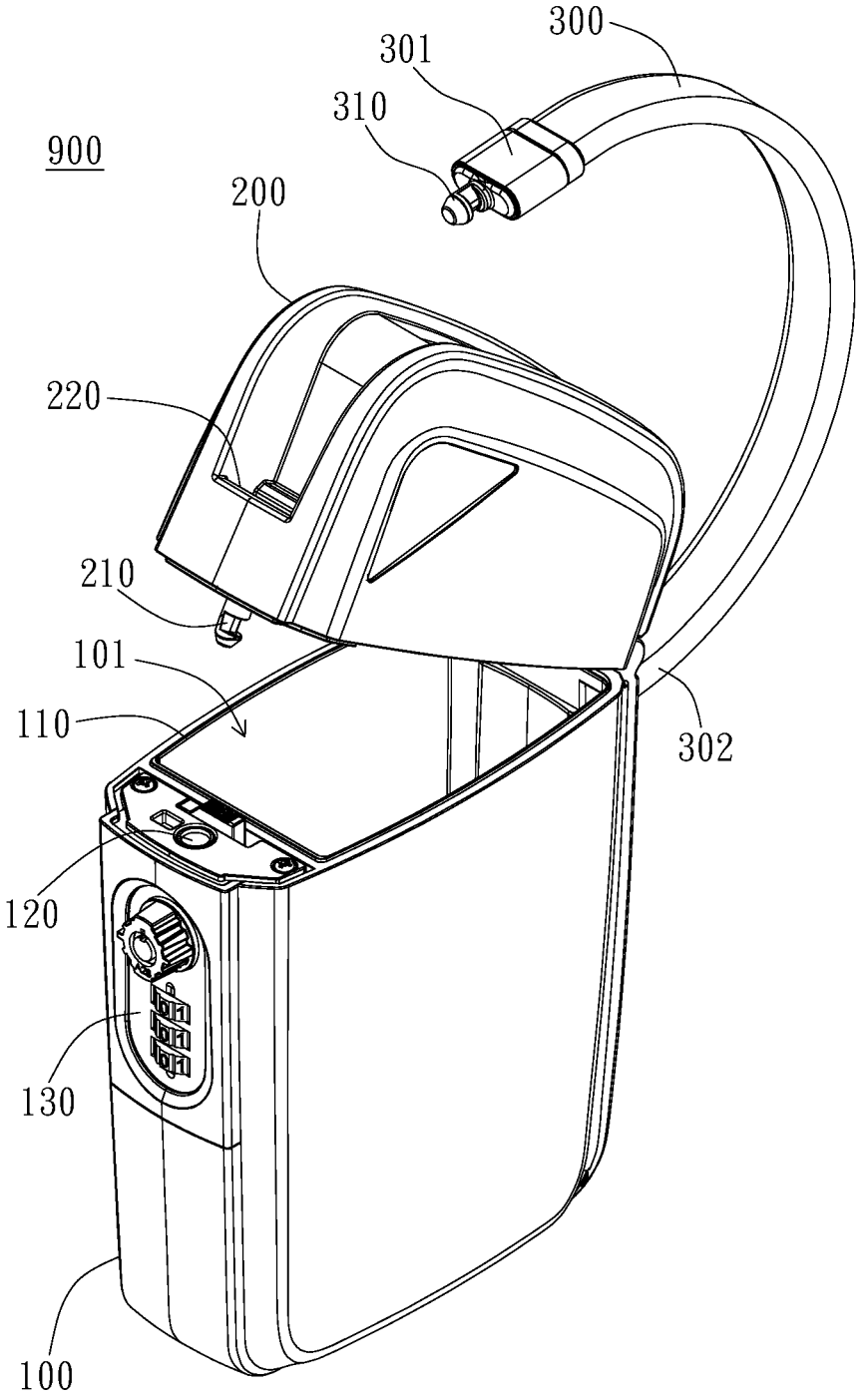
FIG. 4 is schematic view of the lock box of the present invention shows that the cap is open on the box and the cable is unlocked.

As shown in the embodiment in FIG. 2, one end 302 of the cable 300 is fixed on the box 100 and the other end 301 of the cable 300 has a cable fixing part 310 (see FIG. 4). In different embodiments, however, the end 302 of the cable 300 is fixed on the cap 200. The cable fixing part 310 can be inserted into the cap socket 220 with its movement being restricted by the restricting device 230 (see FIG. 3B). As shown in the embodiment in FIGS. 3A and 3B, the lifting lever 231 is located outside the accommodating space 101 when the cap 200 doesn't cover the box opening 110. A user can apply a force on the lifting lever 231 to release the restriction on the movement of the cable fixing part 310 by the restricting device 230. At this time, as shown in the embodiment in FIG. 4, the cable fixing part 310 and the other end 301 of the cable 300 are able to leave the cap socket 220, i.e. the cable 300 is unlocked. On the other hand, the user can further choose to place the cap 200 back on the box 100.

Figure 5:
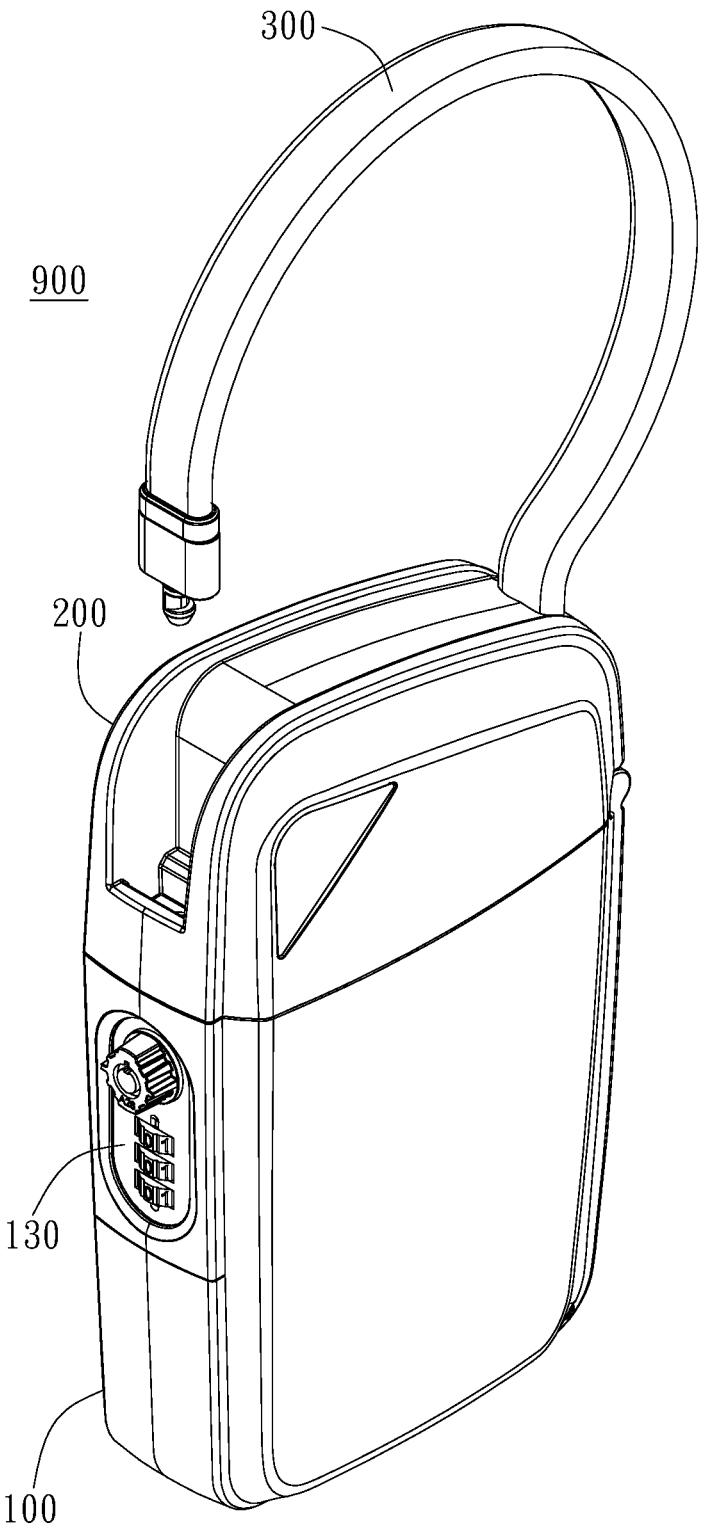
FIG. 5 is schematic view of the lock box of the present invention shows that the cap covers the box and the cable is unlocked.
Figure 6A:
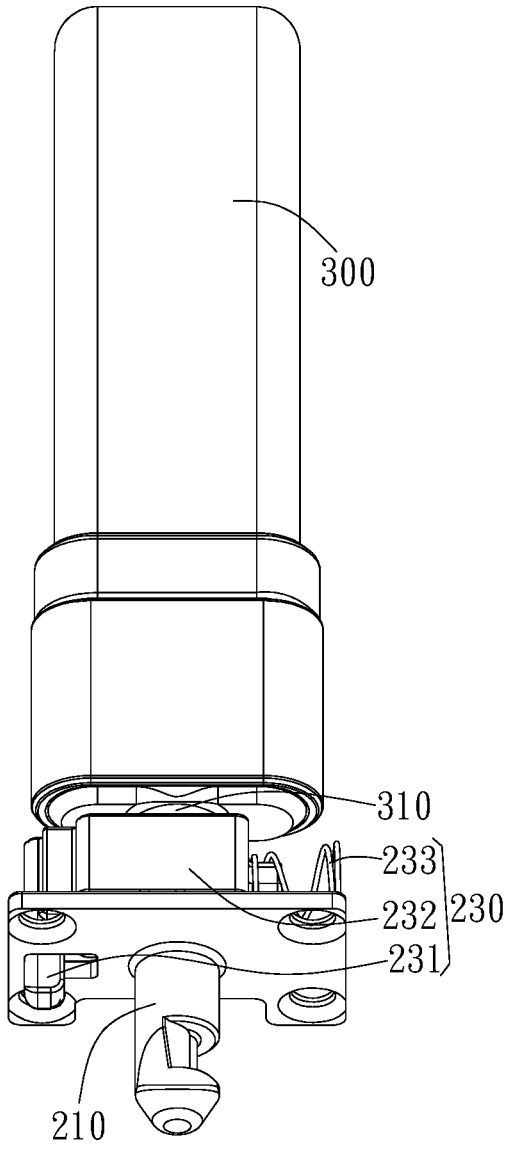
FIGS. 6A-8 are schematic views show the movement of the restricting device with respect to the cable fixing part.
Figure 6B:
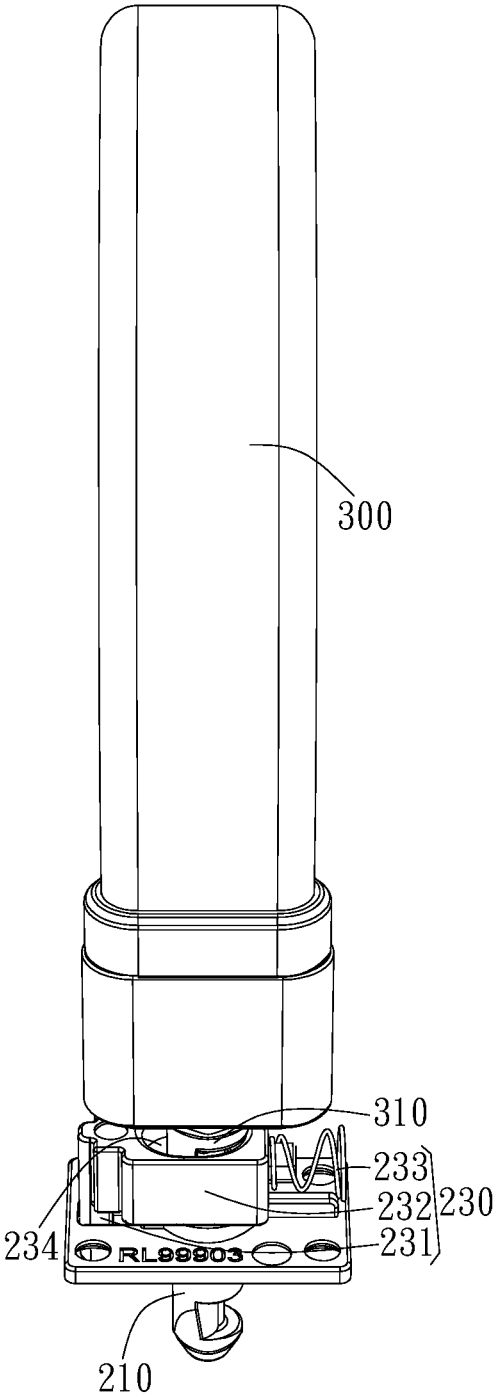

Accordingly, one can selectively open the cap 200 or unlock the cable 300, instead of having to open/unlock the cap 200 and the cable 300 at the same time. Hence, the lock box 900 of the present invention is more convenient to use. More particularly, the user can lift the cap 200 and unlock the cable 300 as shown in FIG. 4, put objects such as cards and keys into the accommodation space 101 of the box 100, and then place the cap 200 back on the box 100 as shown in FIG. 5 to prevent the objects from dropping out of the box 100. After arriving at the location of an article to which one wishes to attach the lockbox (such as a chair on a beach), the user can insert the cable 300 through the article and insert the cable fixing part 310 into the cap socket 220. Since the lifting lever 231 would be located outside the accommodating space 101 only when the cap 200 doesn't cover the box opening 110, one has to unlock the lock body 130 and open the cap 200 before removing the cable fixing part 310 from the cap socket 220. Thus, the lock box 900 can be locked on the article. Furthermore, for the lock box 900 of the present invention, only one lock body 130 is needed to lock the cap 200 directly and the cable 300 indirectly lock.

The movement of the restricting device 230 with respect to the cable fixing part 310 is further described below.

As shown in the embodiment in FIG. 6A to FIG. 8, the restricting device 230 includes the lifting lever 231, a block 232, and an elastic member 233. The block 232 connects with the lifting lever 231. The cable fixing part 310 can be inserted into the cap socket 220 (see FIG. 4) and engages with the block 232. The elastic member 233 is disposed between the block 232 and the inner wall of the cap 200 (see FIG. 4).

Figure 7A:
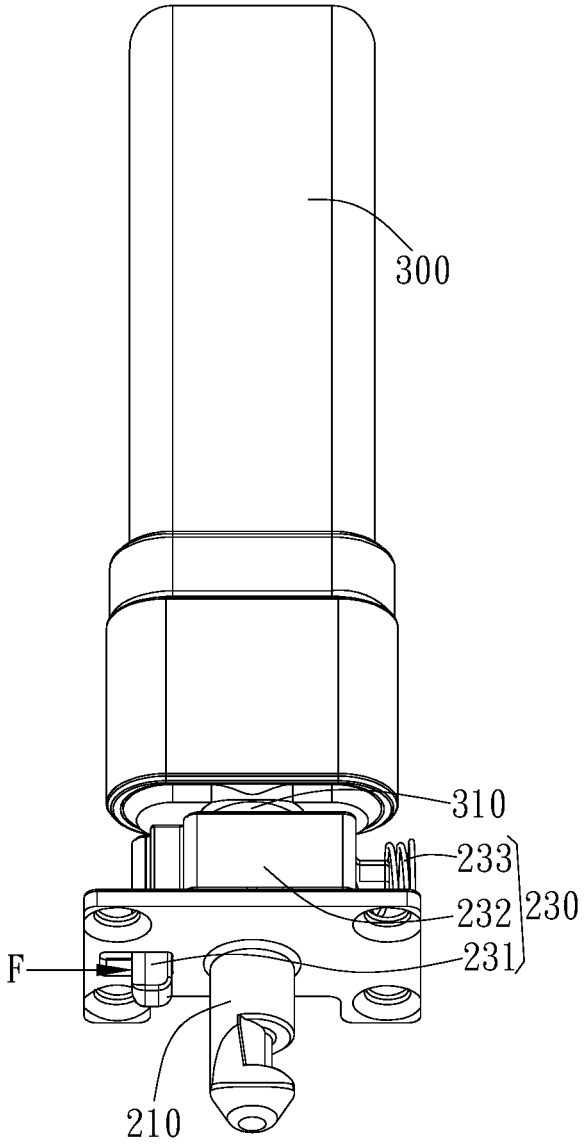
Figure 7B:
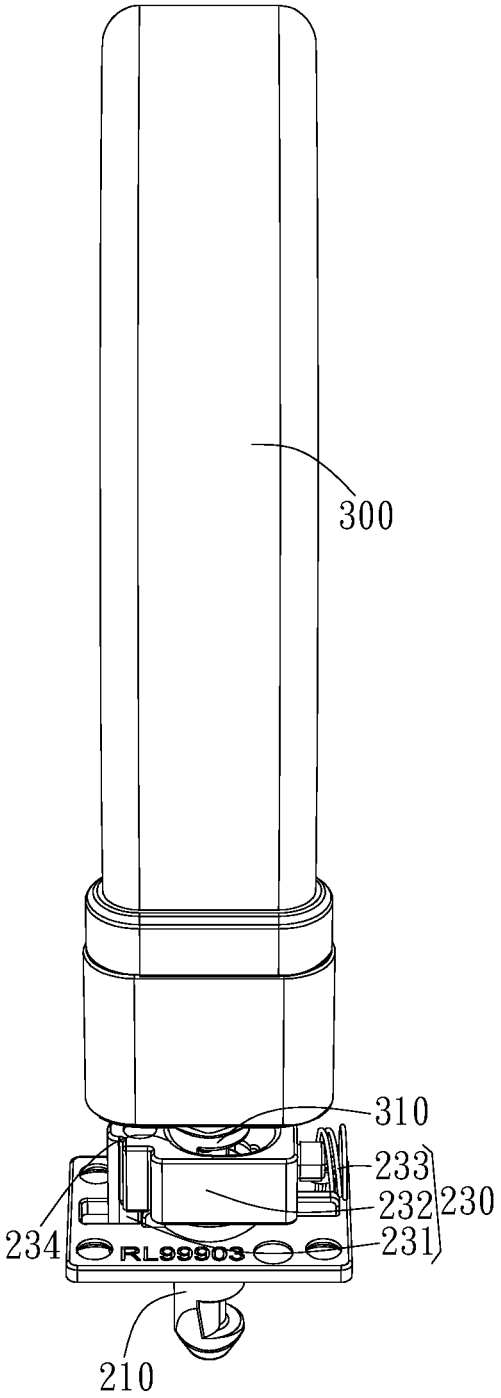
Figure 8:
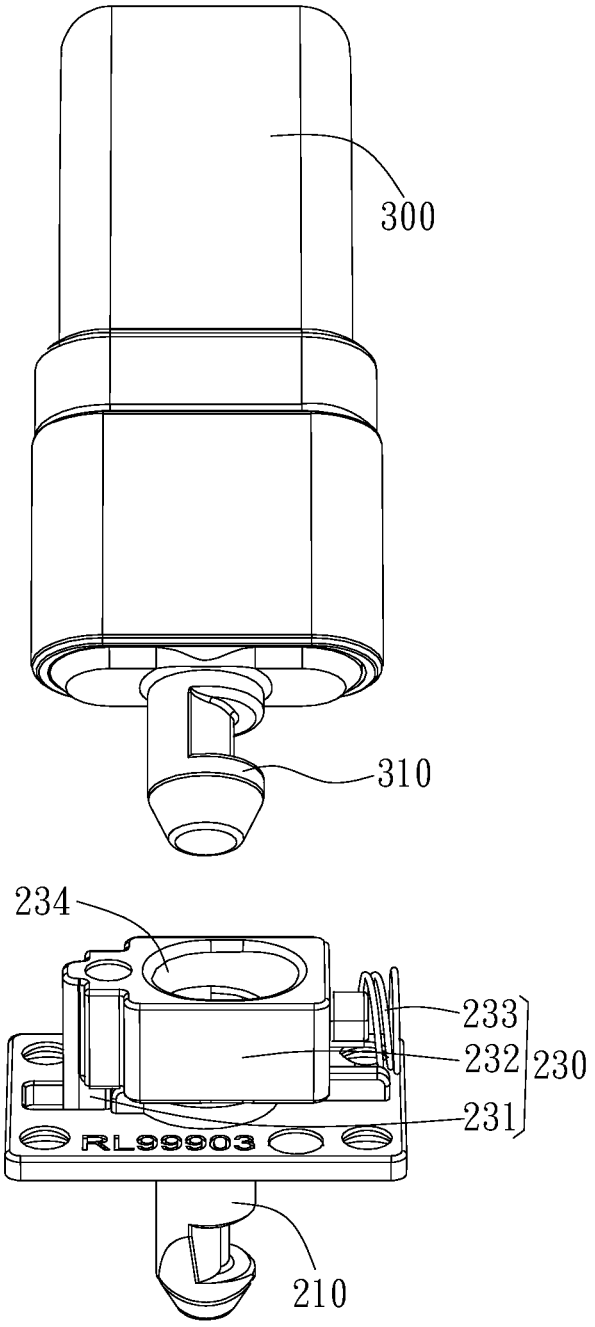

More particularly, the cable fixing part 310 is a hook-shaped unit (see FIG. 8), wherein the block 232 includes a block hole 234. As shown in the embodiment in FIGS. 6A and 6B, the cable fixing part 310 can be inserted into the cap socket 220 (see FIG. 4) and engage with the edge of the block hole 234. When the user applies a force F on the lifting lever 231 to make the restricting device 230 move to the location as shown in FIGS. 7A and 7B, the restriction on the movement of the cable fixing part 310 by the restricting device 230 is released since the cable fixing part 310 is not engaged with the edge of the block hole 234. At this time, as shown in the embodiment in FIG. 8, the cable fixing part 310 is able to leave the restricting device 230, i.e. the cable 300 is unlocked.

Figure 9:
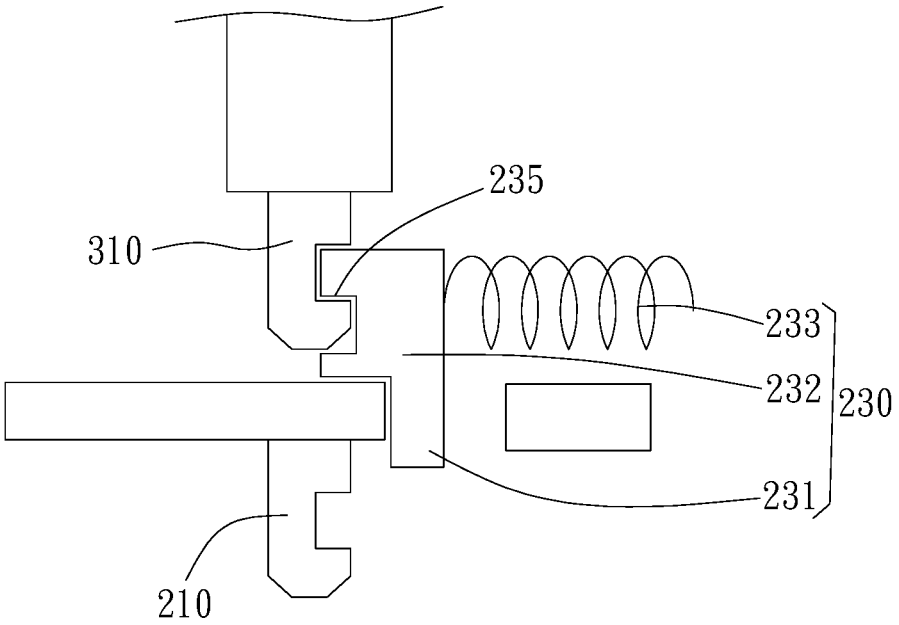
FIGS. 9 and 10 are schematic views different embodiments of the restricting device and the cable fixing part.
Figure 10:
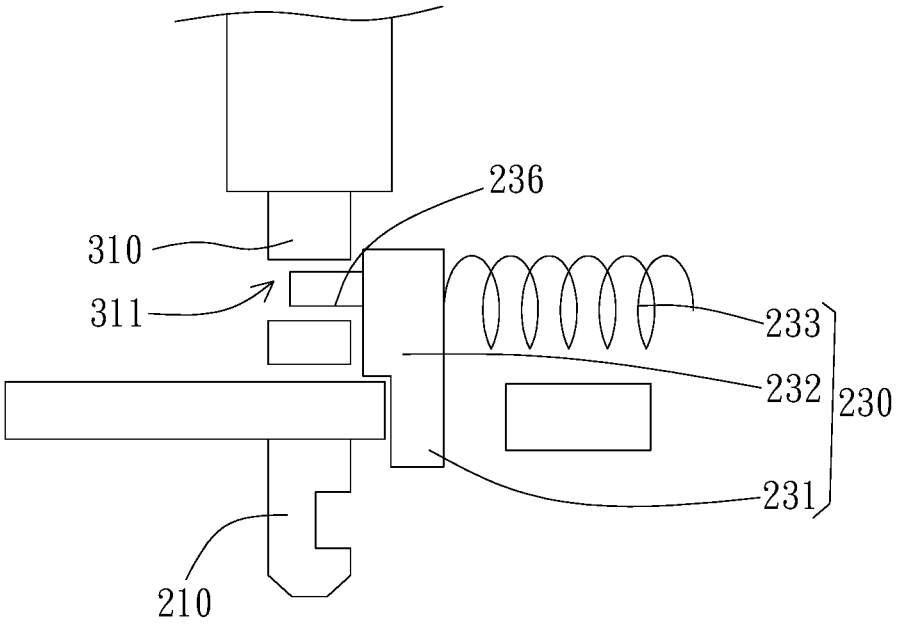

In different embodiments, the cable fixing part 310 and the block 232 can be modified according to the manufacturing, design, and usage requirements. As shown in the embodiment in FIG. 9, the block 232 includes an engaging portion 235, wherein the cable fixing part 310 can be inserted into the cap socket and engages with the engaging portion 235. As shown in the embodiment in FIG. 10, the cable fixing part 310 includes a fixing hole 311, wherein the block 232 includes an engaging part 236. The cable fixing part 310 can be inserted into the cap socket and makes the engaging part 236 engage with the edge of the fixing hole 311.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lock box, comprising:

a box having an accommodating space inside, comprising;

a box opening;

a lock hole disposed at a location on the box other than the box opening;

a lock body disposed at a location on the box other than the box opening and the lock hole;

a cap capable of covering the box opening to seal the accommodating space, including:

a cap fixing part protruding from one side of the cap facing the box opening, wherein the cap fixing part is able to extend into the lock hole and be locked by the lock body when the cap covers the box opening;

a cap socket disposed on the other side of the cap with respect to the cap fixing part;

a restricting device disposed in the cap, wherein the restricting device has a lifting lever protruding from one side of the cap facing the box opening;

a cable, wherein one end of the cable is fixed on either the box or the cap and the other end of the cable has a cable fixing part, wherein the cable fixing part can be inserted into the cap socket with its movement being restricted by the restricting device, wherein the lifting lever is located outside the accommodating space when the cap doesn't cover the box opening, a user can apply a force on the lifting lever to release the restriction on the movement of the cable fixing part by the restricting device.

2. The lock box of claim 1, wherein the restricting device includes:

the lifting lever;

a block connecting with the lifting lever, wherein the cable fixing part can be inserted into the cap socket and engages with the block;

an elastic member disposed between the block and the inner wall of the cap.

3. The lock box of claim 2, wherein the cable fixing part is a hook-shaped unit.

4. The lock box of claim 3, wherein the block includes a block hole, wherein the cable fixing part can be inserted into the cap socket and engages with the edge of the block hole.

5. The lock box of claim 3, wherein the block includes an engaging portion, wherein the cable fixing part can be inserted into the cap socket and engages with the engaging portion.

6. The lock box of claim 2, wherein the cable fixing part includes a fixing hole.

7. The lock box of claim 6, wherein the block includes an engaging part, wherein the cable fixing part can be inserted into the cap socket and makes the engaging part engage with the edge of the fixing hole.

8. The lock box of claim 1, wherein the cap is pivotally connected with one side of the box.

9. The lock box of claim 1, wherein the cap is removable from the box.

10. The lock box of claim 1, wherein the cap fixing part is a hook-shaped unit.

* * * * *